US005501770A

United States Patent [19]

Sarkar et al.

[11] Patent Number: 5,501,770

[45] Date of Patent: Mar. 26, 1996

[54] ENZYMES IN COMBINATION WITH POLYELECTROLYTES FOR ENHANCING THE FREENESS OF CLARIFIED SLUDGE IN PAPERMAKING

[75] Inventors: Jawed M. Sarkar, Naperville; Hanuman P. Didwania, Lisle, both of Ill.

[73] Assignee: Nalco Chemical Company, Naperville, Ill.

[21] Appl. No.: 289,451

[22] Filed: Aug. 12, 1994

[51] Int. Cl.[6] ..... D21H 21/10

[52] U.S. Cl. ..... 162/100; 162/147; 162/158; 162/168.2; 162/168.3; 162/182; 162/183; 162/189; 162/9; 210/606; 210/632; 210/728; 210/928

[58] Field of Search ..... 162/5, 5 B, 72 B, 162/9, 100, 158, 168.2, 168.3, 183, 182, 189; 210/606, 632, 928, 728

[56] References Cited

U.S. PATENT DOCUMENTS

| | | | |
|---|---|---|---|
| 3,406,089 | 10/1968 | Yerkes | 162/199 |
| 4,923,565 | 5/1990 | Fuentes | 162/72 B |
| 5,169,497 | 12/1992 | Sakar | 162/72 B |
| 5,308,449 | 5/1994 | Fuentes | 162/72 B |

FOREIGN PATENT DOCUMENTS

| | | | |
|---|---|---|---|
| 451031 | 10/1991 | European Pat. Off. | 210/606 |
| 2633514 | 2/1978 | Germany | 210/606 |

OTHER PUBLICATIONS

Eriksson, "Swedish Developments in Biotechnology Related to the Pulp and Paper Industry", *Tappi Journal*, vol. 68, No. 7 (Jul. '85) pp. 46–55.

*Primary Examiner*—Peter Chin

*Attorney, Agent, or Firm*—James J. Drake; Robert A. Miller

[57] ABSTRACT

A process for improving the freeness of paper pulp, which comprises the steps of adding to the pulp at least 0.05%, based on the dry weight of the pulp, of a cellulolytic enzyme, allowing the pulp to contact the cellulolytic enzyme for from about 40 minutes to about 60 minutes at a temperature of at least 40° C., adding at least 0.011%, based on the dry weight of the pulp, of a water soluble cationic polymer, adding at least 0.007%, based on the dry weight of the pulp, of a water soluble anionic or nonionic polymer and forming the thus treated pulp into paper.

8 Claims, No Drawings

ENZYMES IN COMBINATION WITH POLYELECTROLYTES FOR ENHANCING THE FREENESS OF CLARIFIED SLUDGE IN PAPERMAKING

BACKGROUND OF THE INVENTION

1. Field of the Invention

The invention relates to a combination of cellulolytic enzymes with cationic and anionic polymers for use in enhancing the freeness of clarified sludge in papermaking.

2. Description of the Prior Art

More and more the papermaking industry uses recycled papers. For example, for the manufacture of corrugated cardboard, raw materials which are based on recycled fibers are being used more frequently and, at the same time, the number of recyclings is increased. With each recycling, the quality of the raw materials is lessened so that fiber strength is reduced, and more fines are generated. Further, more contaminants are accumulated. All of these problems result in decreasing freeness of pulp.

One product of papermaking is so-called clarified sludge. Clarified sludge is a concentrate of pulp and paper mill effluent which contains solids primarily in the form of fiber fines. Old newsprint (ONP) is another type of recycled furnish. The fiber fines found in clarified sludge usually are smaller than 10 microns. Also contained within clarified sludge are hemicellulose and chemical substances such starch, rosin, alum, hot melts (commonly referred to as stickies and tackies) and organic matter. Clarified sludge is typically land filled at a tremendous cost to the paper makers and the environment. The amount and types of fines (commonly referred to as "anionic trash") are too difficult and uneconomical to treat by conventional mechanical/chemical methods. These methods include refining, screening and treatment with retention and drainage aids. In the industry, so-called recycle furnish, which is an aqueous suspension that has gone through the papermaking process 1 to 2 times, is used.

ONP should also be distinguished from other recycle pulps including old corrugated containers (OCC) which are treated in a pulper with hot water under a continuous agitation until a pulp is produced. Typically, OCC fibers have a greater length then clarified sludge, since they are a mixture of chemical mechanical pulp (CMP) and chemical thermal mechanical pulp (CTMP) which are derived from hardwoods and kraft cuttings. Further, clarified sludge differs from OCC in many physical characteristics, including consistency, bulk viscosity, pH, charge, fiber strength and the composition of solid contents. The clarified sludge contains abundant viscous microbial polysaccharides. These biopolymers hold copious amounts of water and are difficult to treat with conventional methods. Enzymes can break down the polysaccharide structure which may enhance the drainage of the sludge.

The pulps in aqueous suspension which are ready to be used on a paper machine can be characterized by various parameters, one of which is particularly significant for predicting the draining capability of the pulp. A measure of the drainability of the pulp is frequently expressed in the term "freeness". Specifically, freeness is measured according to Canadian Standard Freeness, or CSF measurement. CSF measures the drainage of 3 grams (oven dried weight) of pulp suspended in one liter of water.

Use of cellulolytic enzymes, e.g. the cellulases and/or the hemicellulases for treating recycled paper pulps to improve freeness is the subject of U.S. Pat. No. 4,923,565 the disclosure of which is incorporated herein by reference. The cellulase enzyme described in the '565 patent may be used in the practice of the present invention.

U.S. Pat. No. 5,169,497, issued to Sarkar and Cosper discussed the effects of cellulases in combination with cationic flocculants of varying composition on the freeness of old corrugated containers (OCC) pulp. The '497 patent covers the use of a combination of enzyme and cationic polymers for enhancing the freeness of recycled fiber. In practice, dual polymer treatment programs are also used for retention.

The pulp is first treated with a cellulolytic enzyme followed by cationic and anionic polymers. In a dual polymer retention system, two synthetic polymers are mixed with the pulp sequentially to achieve better results than obtained with either polymer by itself. Usually, a low molecular weight, highly charged cationic polymer is added to the papermaking furnish first, and then at a later stage, a high molecular weight, anionic polymer is added. Dual polymers have found a place in paper and board manufacturing. Good retention has numerous economic benefits. As the use of recycled fiber increases in container board, fine paper, and newsprint grades, the opportunity to provide benefits through retention aids has also increased. If fines are not retained by a good retention aid or hydrolyzed by an enzyme, they will impede drainage, fill felts, and cause deposition problems. The key benefit of retention aids with enzyme is to prevent drainage reduction and subsequent loss of machine speed. Drainage can be maintained by preventing the build-up of fines in the white water loop.

U.S. Pat. No. 5,308,449, issued to Fuentes et al. discusses the use of enzymes as a method of treating recycled paper for use as a papermaking pulp. Fuentes et al. does not addresses the problem of clarified sludge in the recovery of pulp from within that sludge for later use in papermaking. Further, there is no discussion in Fuentes et al. of the use of treatment agents for enhancing the freeness and drainability of pulp once the recycled paper has been introduced back into the papermaking process.

Ideally, a method would exist which would allow for the recovery of paper pulp from clarified sludge while at the same time increasing the freeness and drainability of any resulting paper pulp once it is processed through the papermaking machinery.

The object of the present invention to disclose a method of treating previously unused clarified sludge for re-use in the papermaking system. By re-using clarified sludge, substantial economic benefits may be derived in terms of decreased waste removal cost as well as increased efficiency in the use of materials by the papermaking industry. Since old newsprint pulp is significantly less costly than OCC pulp, papermaking mills will recognize significant economic benefits.

SUMMARY OF THE INVENTION

A process for enhancing the freeness of clarified sludge and/or ONP, which comprises the steps of adding to the pulp at least 0.05%, based on the dry weight of the pulp, of a cellulolytic enzyme, allowing the pulp to contact the cellulolytic enzyme for from about 40 minutes to about 60 minutes at a temperature of at least 40° C., adding at least 0.011%, based on the dry weight of the pulp, of a water soluble cationic polymer, adding at least 0.007%, based on the dry weight of the pulp, of a water soluble anionic polymer and forming the thus treated pulp into paper.

DESCRIPTION OF THE PREFERRED EMBODIMENTS

A variety of water soluble cationic coagulants may be used in the practice of the invention. Both condensation and vinyl addition polymers may be employed. For a list of water soluble cationic polymers, reference may be had to Canadian patent 731,212, the disclosure of which is incorporated herein by reference.

A preferred group of cationic polymers are the cationic polymers of acrylamide which in a more preferred embodiment of the invention, contain from 40–89% by weight of acrylamide. Larger or smaller amounts of acrylamide in the polymers may be used, e.g., between 30–80%. Typical of the cationic monomers, polymerized with acrylamide are the monomers diallyldimethyl ammonium chloride, (DADMAC), dimethylaminoethyl/acrylate methylchloride quaternary ammonium salt, (DMAEA.MCQ), epichlorohydrin dimethylamine condensate polymer (epi-DMA) and ethylene dichloride (EDC-$NH_3$). When these cationic acrylamide polymers are used they should have a RSV (reduced specific viscosity) of at least 3 and preferably the RSV should be within the range of 5–20 or more. RSV was determined using a one molar sodium nitrate solution at 30° C. The concentration of the acrylamide polymer in this solution is 0.045%.

A preferred group of anionic polymers are polymers of acrylamide containing 20–95% acrylamide and 5 to 80% anionic monomer by weight of the polymer such as acrylic acid or methacrylic acid.

The invention has utility in improving the drainage or the freeness of a wide variety of sludges and paper pulps, including Kraft and other types of pulp. The invention is particularly useful in treating pulps that contain recycled fibers. The effectiveness of the invention in improving drainage is most notable when the pulps contain at least 10 percent by weight of recycled fiber, with great improvements being evidenced when the recycled fiber content or the pulp being treated is at least 50% or more.

As indicated, the invention requires that the sludge or pulp first be treated with an enzyme, then with a cationic polymer and, finally, with an anionic polymer. It is also important to the successful practice of the invention, that the conditions under which the treatment with the enzyme occurs is such to provide optimum reaction time of the enzyme of the pulp.

The treatment of the sludge or pulp with the enzyme is preferably conducted for a period of time not greater than 60 minutes. The minimum treating time is about 30 minutes. A typical treating time would be about 40 minutes. The pH of the pulp to achieve optimum results should be between the ranges of 5 to 7.5. The temperature of the treatment should not be below 20° C., and usually should not exceed 60° C. A typical average reaction temperature is favorably conducted is 40° C.

The preferred dosage of the cationic polymer, as actives, is from 0.025% to 0.02% polymer based on the dry weight of the pulp. A general dosage which may be used to treat the pulp with the polymer is from 0.01% to 0.08% by weight of the polymer. The preferred dosage of anionic polymer, as actives, is 0.025% –0.075% polymer based on the dry weight of the pulp.

The enzyme dosage based on the dry weight of the pulp in a preferred embodiment ranges from about 0.05 to about 0.4 percent by weight. A general treatment range of the enzyme that may be used is from 0.1 to 0.2 percent by weight.

In order for the enzyme to have sufficient reaction time and mixing described above, it is necessary that they be added to the pulp at the point in the paper making system to allow sufficient time for the above conditions to occur. Thus, a typical addition point in paper making system would be the machine chest. Other places where suitable contact time would occur may also be used as additional points.

The following examples are presented to describe preferred embodiments and utilities of the invention and are not meant to limit the invention unless otherwise stated in the claims appended hereto.

We claim:

1. A process for enhancing the freeness of pulp and paper mill clarified sludge which comprises the sequential steps of:

a) adding to the sludge at last 0.05% based on the dry weight of the sludge of a cellulolytic enzyme;

b) allowing the sludge to contact the cellulolytic enzyme for about 30 minutes to about 60 minutes at a temperature of at least 40° C.;

c) adding to the sludge at least 0.011% based on the dry weight of the sludge of a water-soluble cationic polymer as a retention aid; and d) adding to the sludge at least 0.007% based on the dry weight of the sludge of a water soluble anionic copolymer selected form the group consisting of acrylamide/acrylic acid and acrylamide/methacrylic and copolymers.

2. The process of claim 1, wherein the water soluble cationic polymer is a copolymer which contains from 20% to 80% by weight of acrylamide.

3. The process of claim 2, wherein the cationic polymer is an acrylamide-diallyldimethyl ammonium chloride copolymer.

4. The process of claim 1, wherein the anionic polymer is an acrylamide polymer comprising from about 20 to 95% acrylamide and from about 5 to 80% anionically charged acrylic acid by weight of the polymer.

5. A process for enhancing the freeness of recycled newsprint pulp which comprises the sequential steps of:

a) adding to the pulp at least 0.05% based on the dry weight of the pulp of a cellulolytic enzyme;

b) allowing the pulp to contact the cellulolytic enzyme for about 30 minutes to about 60 minutes at a temperature of at least 40° C.;

c) adding at least 0.011% based on the dry weight of the pulp of a water-soluble cationic polymer as a retention aid; and d) adding at least 0.007% based on the dry weight of the pulp of a water soluble anionic copolymer of acrylamide/acrylic acid.

6. The process of claim 5, wherein the water soluble cationic polymer is a copolymer which contains from 20% to 80% by weight of acrylamide.

7. The process of claim 6, wherein the cationic polymer is an acrylamide-diallyldimethyl ammonium chloride copolymer.

8. The process of claim 5, wherein the anionic polymer is an acrylamide polymer comprising from about 20 to 95% acrylamide and from about 5 to 80% anionic monomer by weight of the polymer.

* * * * *